United States Patent [19]

Nagel

[11] Patent Number: 4,755,692

[45] Date of Patent: Jul. 5, 1988

[54] VITAL SAFETY MONITORING CIRCUIT

[75] Inventor: Harry C. Nagel, Shaler Township, Allegheny County, Pa.

[73] Assignee: American Standard Inc., North Hills, Pa.

[21] Appl. No.: 60,134

[22] Filed: Jun. 9, 1987

Related U.S. Application Data

[63] Continuation of Ser. No. 631,967, Jul. 18, 1984.

[51] Int. Cl.[4] ..... H03K 5/153; H03K 5/22

[52] U.S. Cl. ..... 307/200 A; 307/359; 307/257; 328/119

[58] Field of Search ..... 307/200 A, 359, 354, 307/362, 282, 494, 257; 328/119, 120; 364/550

*Primary Examiner*—Stanley D. Miller
*Assistant Examiner*—Timothy P. Callahan
*Attorney, Agent, or Firm*—J. B. Sotak

[57] ABSTRACT

A vital safety monitoring circuit including an electromagnetic transformer for feeding periodic check signals into one leg of a balanced bridge network having a pair of input and output terminals. A solid-state switching circuit is connected across the pair of input terminals. An operational amplifier circuit is connected across the pair of output terminals. An optical coupler circuit is connected to the operational amplifier for producing output signals corresponding to the periodic check signals when the solid-state switching circuit is nonconductive and in the absence of a critical component or circuit malfunction.

20 Claims, 1 Drawing Sheet

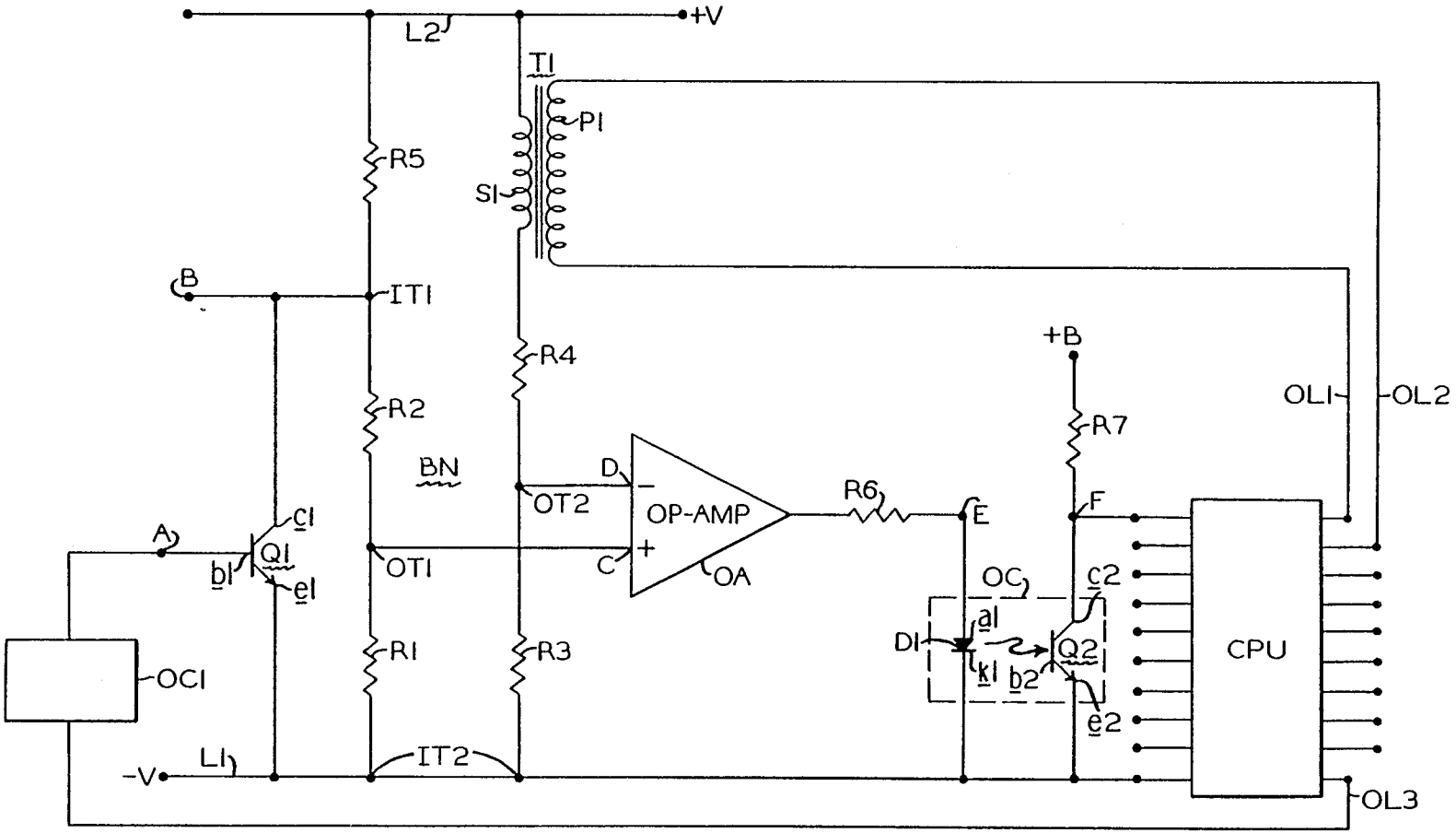
OL2
OL3
OL1
CPU
+B
R7
F
c2
Q2
e2
b2
OC
a1
k1
D1
E
R6
OP-AMP
OA
D
C
+V
P1
T1
S1
R4
OT2
R3
L2
R5
IT1
R2
BN
OT1
R1
IT2
c1
Q1
e1
b1
B
A
L1
-V
OC1

VITAL SAFETY MONITORING CIRCUIT

This is a continuation of co-pending application Ser. No. 631,967 filed on July 18, 1984.

FIELD OF THE INVENTION

This invention relates to a vital safety monitoring circuit and, more particularly, to an improved output driver circuit arrangement for checking the electrical state appearing at a select point by inducing a check signal into a bridge network which is balanced when the select point is at a first electrical state and which becomes unbalanced when the select point assumes a second electrical state.

BACKGROUND OF THE INVENTION

In various control systems, such as, in pulse coded track circuits for railroad and mass and/or rapid transit operations, it is desirable to place at each wayside location where adjacent track sections are adjoining, a single central data processor unit (CPU) which provides control and/or data processing for a pair of an associated transmitter and receiver. The transmitter and receiver are connected to one of each track circuit, that is, to the rails of the corresponding track section. The central data processor unit (CPU) correlates the local conditions and establishes the pulse code transmitted in both directions through the track rails. Each of the processor units also decodes the received pulses to register the data picked up from the other end of the associated track section. In practice, the data processor unit is preferably a solid-state microprocessor device which is conventional and readily commercially available from any one of a number of electronics manufacturers. The CPU incorporates or is associated with the necessary memory, such as, programmable read only memory (PROM) devices which may be included therein. The CPU also receives inputs from the local devices which detect train presence and traffic conditions and records other data which is to be reported. The received data is registered in solid-state relays and is used to control the flow of traffic and to perform other functions. The processor unit also monitors the operation of the output register relays, the input signals from the wayside logic, and other functions through the use of monitoring devices and feedback signals. When these operational checks and monitoring devices determine that the system is functioning properly, and the results are in agreement and comparable to that which is expected, the CPU generates a signal having a predetermined special characteristic. When this signal is conveyed to the local power supply, a source of supply energy is available at that location for powering the system apparatus. The continued operation of the power supply is dependent upon the reception of the special check signal from the processor unit, and the power supply is inhibited in the absence of the check signal. Thus, the system is shut down at any given location when an indication of improper operation or failure of any of the system elements are indicated to assure vital safety or vitality of the system.

OBJECTS AND SUMMARY OF THE INVENTION

Accordingly, it is an object of this invention to provide a vital safety circuit for monitoring the electrical condition on an output terminal.

Another object of this invention is to provide an improved monitoring circuit for checking the electrical state appearing at an output.

A further object of this invention is to provide a unique electronic circuit arrangement for monitoring an output condition.

Still another object of this invention is to provide an electronic monitoring circuit for checking the presence of a periodic signal.

Still a further object of this invention is to provide a new and improved circuit arrangement for monitoring a check signal which is injected into a balanced bridge network.

Yet another object of this invention is to provide a vital electronic circuit having a bridge network, an operational amplifier, and an optical coupler for supplying a special signal to a data processor unit which generates the special signal which is transformer coupled to the bridge network.

Yet a further object of this invention is to provide a vital circuit comprising, a transformer for coupling a periodic check signal into one leg of a bridge network having a pair of input and output terminals, a switching circuit connected across said pair of input terminals, an amplifying circuit connected across said pair of output terminals, and a coupling circuit connected to said amplifying circuit for producing an output signal corresponding to the periodic signal when said switching circuit is nonconductive and in the absence of a critical component or circuit malfunction.

An additional object of this invention is to provide a vital safety monitoring circuit arrangement comprising, first means for producing a check signal, second means coupled to said first means for receiving said check signal from said first means, third means coupled to said second means for controlling the conductive condition of said second means, fourth means coupled to said second means for amplifying said check signal when said third means causes said second means to assume a balance condition, and fifth means for receiving said amplified check signal for continuing the production of said check signal until said third means causes said second means to assume an unbalanced condition.

DESCRIPTION OF THE DRAWING

The foregoing objects and other attendant features and advantages of the invention will be more readily understood from the foregoing detailed description when considered in conjunction with the accompanying drawing wherein:

The single FIGURE is a schematic circuit diagram of a vital electronic monitoring circuit embodying the principles of the present invention.

DETAILED DESCRIPTION OF THE INVENTION

Referring now to the single FIGURE of the drawing, there is shown a preferred embodiment of the vital safety type of electronic output driver monitoring circuit for checking an output condition to ascertain whether the output condition corresponds to the state which is stored in the memory of a microprocessor. As shown, the solid-state monitoring circuit includes a balanced bridge network BN with each leg having one of four equal valued resistors R1, R2, R3 and R4. It will be seen that the lower end of resistor R1 is connected to common lead L1 which is connected to a suitable source of negative voltage −V. The upper end of resistor R1 is connected to the lower end of resistor R2 to form a first output terminal OT1. The upper end of resistor R2 is connected to the lower end of a resistor R5 which has a relatively small resistance in comparison to the values of resistors R1, R2, R3 and R4. Thus, the junction point between resistors R1 and R2 forms a first input terminal IT1. The upper end of resistor R5 is connected to lead L2 which is connected to a suitable source of positive voltage +V. As shown, the lower end of resistor R3 is directly connected to common lead L1 which functions as the second input terminal IT2. The upper end of resistor R3 is connected to the lower end of resistor R4 to form a second output terminal OT2. The upper end of resistor R4 is connected to positive voltage lead L2 via a low impedance secondary winding S1 of an electromagnetic transformer T1 which will be described in greater detail hereinafter. Thus, the upper end of resistor R4 is effectively directly coupled to the first input terminal IT1 through the low impedances exhibited by secondary winding S1 and resistor R5. It will be seen that a switching circuit is connected across resistors R1 and R2 of the bridge network BN. The switch conditioning circuit includes an NPN transistor Q1 having an emitter electrode e1, a base electrode b1, and a collector electrode c1. The emitter electrode e1 is connected to the second input terminal IT2 while the collector electrode c2 is connected to the first input terminal IT1 which forms output terminal B for the transistor switching circuit. The base electrode b1 is connected to input terminal A of the transistor switching circuit.

As shown, the two output terminals OT1 and OT2 of the bridge network BN are connected to the positive noninverting and the negative inverting terminals C and D, respectively, of an operational amplifier OA. The op-amp which may be a single RM741 has an output terminal which is connected to terminal E via a current-limiting resistor R6. It will be seen that output terminal E is connected to the anode electrode a1 of a light emitting diode D1 of an isolation optical coupler OC while the cathode electrode k1 of diode D1 is connected to common lead L1. The optical coupler includes a photosensitive NPN transistor Q2 having a base region b2, an emitter region e2, and a collector region c2. The emitter electrode or region e2 is directly connected to common lead L1 while the collector electrode or region c2 is connected to a suitable source of positive voltage +B via load resistor R7. The output terminal F is connected to one input terminal of a central data processing unit or solid-state microprocessor, such as, an MC6809 type which is conventionally shown by the block designated CPU. The other input of microprocessor CPU is connected to the common lead L1. The solid-state microprocessor CPU may be of any suitable type well known in the art which includes sufficient memory to carry out the various functions which are associated with the operation of a pulse code track circuit system for railroad and mass and/or rapid transit operations.

As shown, a pair of output leads OL1 and OL2 are interconnected between microprocessor CPU and a primary winding P1 of the transformer T1. If the microprocessor CPU receives all of the appropriate or correct information data, a check signal is conveyed over leads OL1 and OL2 to the primary winding P1. The check signal may be continuous pulses having, for example, a frequency of 500 Hz or may be a periodic pulse which is developed at selected fixed intervals Further, it will be seen that another output lead OL3 of the microprocessor CPU is connected by an isolation optical coupler OC1 to the input terminal A which is connected to the base electrode b1 of the switching transistor Q1. The optical couplers OC and OC1 provide the necessary isolation between the positive supply voltage +B and the voltage sources −V and +V.

In describing the operation, it will be assumed that the monitoring circuit is intact, that the components are functioning properly, and that the appropriate information data is being conveyed to the microprocessor CPU. Under this condition, the switching transistor Q1 is in a nonconducting state, and the a.c. check signal is conveyed to the primary winding P1. Thus, an a.c. signal is induced in the secondary winding S1. Since the bridge network is in a balanced state due to the nonconduction of transistor Q1, the output terminals OT1 and OT2 are at substantially the same d.c. voltage levels. Thus, the a.c. ripple appearing in the bridge leg having resistors R3 and R4 will cause the voltage at output terminal OT2 to rise and fall with respect to the voltage at output terminal OT1. Thus, the operational amplifier OA will be toggled or switched ON and OFF at the same rate as the frequency of the a.c. ripple. Thus, the amplified output at terminal E alternately forward biases and back biases the light emitting diode D1 to cause the transistor Q2 to turn ON and OFF at the same rate as the frequency of the a.c. ripple. Thus, the a.c. signal at terminal F is conveyed to the input of microprocessor CPU to confirm the fact that the switching transistor Q1 is deenergized and that terminals IT1 and B are at +V. Thus, the microprocessor CPU will continue to generate the check signal to monitor the electrical state of transistor Q1 and the voltage level at output terminal B.

Now let us assume that for some reason all the appropriate or correct data is not received by the microprocessor CPU, then the microprocessor turns ON the switching transistor Q1. The conduction of transistor Q1 causes the bridge network BN to become unbalanced by shunting the resistors R1 and R2 to bring about a reduction of the voltage level at terminals IT1 and B. In practice, the parameters of the circuit components have been designed to cause the d.c. voltage level at terminal IT1 to drop more than the peak-to-peak value of the a.c. ripple so that the voltage on output terminal OT1 is incapable of exceeding the voltage on terminal OT2. Thus, the voltage on input terminal D of the op-amp will continue to remain more positive than the voltage on input terminal C. Accordingly, the operational amplifier OA assumes a steady condition in which a constant negative voltage will appear on output terminal E. Thus, the absence of a.c. ripple on input terminal F results in the CPU recognizing that points B and IT1 are no longer at +V. If, as described in this case, the CPU has caused the voltage at points B and IT1 to fall by energizing Q1, then the lack of an AC voltage at point F is the expected condition. However, if Q1 was not turned ON by the CPU, then the lack of ripple at point F indicates a failure of one or more components of the monitoring circuit results in the voltage at points B and IT1 to decrease. By sensing this lack of a.c. ripple, the CPU is able to take appropriate action, such as deenergizing the defective circuitry, by means of controlling a conditional power supply (not shown) which supplies the supply voltage +B.

It will be appreciated that the foregoing description of this invention is only illustrative, and it is not intended that the invention be limited to the exact embodiment described and that other changes, modifications and alterations within the sphere of the appended claims may be made by those skilled in the art without departing from the spirit and scope of this invention.

Having thus described the invention, what I claim as new and desire to secure by Letters Patent, is:

1. A vital circuit comprising, a transformer for coupling a periodic signal produced by a microprocessor into a leg of a bridge network which has a pair of input and output terminals, a switching circuit connected across said pair of input terminals of said bridge network and assuming a conductive and nonconductive state in response to said microprocessor, an amplifying circuit connected across said pair of output terminals of said bridge network, and a coupling circuit connected from said amplifying circuit to said microprocessor circuit for supplying an amplified output signal corresponding to the periodic signal to said microprocessor when said switching circuit is nonconductive and in absence of a critical component or circuit malfunction in the vital circuit.

2. The vital circuit, as defined in claim 1, wherein said bridge network is a balanced four branch resistor circuit.

3. The vital circuit, as defined in claim 1, wherein said switching circuit includes an NPN transistor.

4. The vital circuit, as defined in claim 1, wherein said coupling circuit includes an optical coupler.

5. The vital circuit, as defined in claim 1, wherein said bridge network includes a plurality of substantially equal value resistors.

6. The vital circuit, as defined in claim 1, wherein said coupling circuit includes a light emitting diode and a photosensitive transistor.

7. The vital circuit, as defined in claim 1, wherein said amplifying circuit includes an operational amplifier.

8. The vital circuit, as defined in claim 1, wherein said switching circuit includes a solid-state device which unbalances said bridge network when rendered conductive.

9. The vital circuit, as defined in claim 1, wherein the periodic signal is an a.c. ripple voltage.

10. The vital circuit, as defined in claim 5, wherein said transformer includes a secondary winding which is serially connected to one of said plurality of substantially equal resistors.

11. The vital circuit, as defined in claim 1, wherein said amplifying circuit includes an operational amplifier having a first input terminal connected to one of said output terminals and having a second input terminal connected to the other of said output terminals.

12. A vital safety monitoring circuit arrangement comprising, first means for producing a check signal, second means having a balanced and an unbalanced condition and coupled to said first means for receiving said check signal from said first means, third means coupled to said second means for establishing a balanced and an unbalanced condition of said second means, fourth means coupled to said second means for amplifying said check signal when said third means causes said second means to assume the balanced condition, and fifth means for receiving said amplified check signal and for supplying said amplified check signal to said first means for causing the continued production of said check signal by said first means until said third means causes said second means to assume the unbalanced condition.

13. The vital safety monitoring circuit arrangement, as defined in claim 12, wherein said first means has a microprocessor for producing said check signal and has an electromagnetic transformer for coupling said check signal to said second means.

14. The vital safety monitoring circuit arrangement, as defined in claim 12, wherein said second means has a balanced bridge network.

15. The vital safety monitoring circuit arrangement, as defined in claim 14, wherein said balanced bridge network has a four legged resistance circuit.

16. The vital safety monitoring circuit arrangement, as defined in claim 12, wherein said third means has a solid-state switching device.

17. The vital safety monitoring circuit arrangement, as defined in claim 16, wherein said solid-state switching device has a normally nonconducting NPN transistor.

18. The vital safety monitoring circuit arrangement, as defined in claim 12, wherein said fourth means has an operational amplifier.

19. The vital safety monitoring circuit arrangement, as defined in claim 12, wherein said fifth means has an optical coupler having a light emitting diode and a photosensitive transistor.

20. The vital safety monitoring circuit arrangement, as defined in claim 15, wherein said first means has a transformer having a secondary winding connected to one of said four legged resistance circuits.

* * * * *